United States Patent [19]

Pedersen

[11] Patent Number: 4,755,060

[45] Date of Patent: Jul. 5, 1988

[54] MIXING APPARATUS WITH A ROTATING MIXING MEMBER

[75] Inventor: Ole K. Pedersen, Copenhagen F, Denmark

[73] Assignee: Ok-Lica Aps, Copenhagen, Denmark

[21] Appl. No.: 833,837

[22] Filed: Feb. 26, 1986

[30] Foreign Application Priority Data

Mar. 7, 1985 [DK] Denmark ..... 1049/85

[51] Int. Cl.[4] ..... B01F 7/24

[52] U.S. Cl. ..... 366/286; 366/186; 366/319; 366/323; 241/282.1

[58] Field of Search ..... 366/319, 323, 186, 194, 366/195, 196, 206, 286; 241/282.1, 282.2

[56] References Cited

U.S. PATENT DOCUMENTS

| | | | |
|---|---|---|---|
| 2,186,716 | 1/1940 | Dieckmann | 241/282.2 |
| 2,626,132 | 1/1953 | Reed | 366/323 |
| 2,626,133 | 1/1953 | Reed | 366/206 |
| 2,926,619 | 3/1960 | Kruder | 366/319 |
| 3,061,279 | 10/1962 | Reed . | |
| 3,299,924 | 1/1967 | Hanschitz | 241/282.2 |
| 4,448,114 | 5/1984 | Mayer . | |
| 4,548,508 | 10/1985 | Verkler | 366/196 |

FOREIGN PATENT DOCUMENTS

| | | |
|---|---|---|
| 325371 | 9/1920 | Fed. Rep. of Germany . |
| 1181091 | 7/1960 | Fed. Rep. of Germany . |

*Primary Examiner*—Robert W. Jenkins

*Attorney, Agent, or Firm*—Felfe & Lynch

[57] ABSTRACT

In a mixing apparatus with a mixing rotor (17) and a mixing chamber (20) with exit openings (29), the rotor and chamber are relatively movable from a mixing position (FIG. 5), in which there is a clearance (43) between the rotor and the wall of the chamber, to a dispensing position (FIG. 6), in which there is no or substantially no clearance. In the mixing position the material (40,41) being mixed circulates (44) within the mixing chamber, and in the dispensing position the rotor (17), being adapted to urge the mixed material (45) towards the exit openings (29), pumps the mixed material out through the exit openings (29) in the form of pasty strands (46) or the like.

Any lumps or hard additives, such as nuts or sweets (candies) that have not been sufficiently comminuted by the mixing member in cooperation with the wall of the mixing chamber, are comminuted by a set of knives (18) cooperating with an end wall (27), in which the exit openings (29) are formed, in the same manner as the knives in a meat mincer cooperates with its perforated disc. Thus, blockage of the exit openings (29) is avoided.

The invention is particularly applicable to the mixing of ice cream stock in the form of hard-frozen ice cream with various additives, such as nuts, frozen fruit chunks or biscuits, the ensuing mixture being dispensed through the exit openings (29), e.g. into a cup (not shown) held by the operator.

4 Claims, 3 Drawing Sheets

MIXING APPARATUS WITH A ROTATING MIXING MEMBER

The present invention relates to a mixing apparatus with a rotating mixing member and a mixing chamber cooperating therewith, said apparatus being of the kind set forth in the preamble of claim 1. Apparatus of this kind are known, inter alia from U.S. Pat. No. 2,626,133, and are especially suited to the mixing of an edible ice or ice cream in the form of a common, relatively hard base material with various additives, such as jam, fruit, sweets (candies), nuts etcetera, and to deliver the mixture so obtained in the form of a pasty mass with the desired properties with regard to taste, flavour and colour.

If in known apparatus of this kind the exit opening is relatively large, it may occur that added nuts or sweets (candies) are only comminuted to a small degree or not at all by the mixing member, so that they are delivered in the form of relatively large lumps. If on the other hand the apparatus is provided with one or a number of small exit openings, these may be blocked by lumps of nut or sweet (candy) material, so that the outflow of the mixed mass is reduced or completely prevented.

It is the object of the present invention to provide a mixing apparatus of the kind initially referred to, in which hard additives like sweets (candies), nuts or the like are positively comminuted without any risk of blockage of the exit openings, and this object is attained with an apparatus according to the invention having a set of radially extending knives which are attached to the end of a mixing member facing an exit opening in an end wall of the mixing chamber, the end wall faces the knives and has a radical plane relative to a rotation axis of the knives. The knives on the end of the mixing member cooperate with the end wall of the mixing chamber is a similar way as the knives in a meat mincer cooperate with the mincer's perforated disc, and thus provide a comminution of nuts, sweets (candies) or parts thereof, which have not been comminuted to a sufficient degree by the mixing member proper coordinating with the wall of the mixing chamber.

The knives are protected against overloading because they are biased toward the end wall of the mixing chamber by a spring means or any similar means known in the art, partly because they can be kept pressed against the end wall with a limited pressure and hence a correspondingly limited friction and limited production of heat.

In a preferred embodiment, the knives are shaped with their surfaces facing the end wall and substantially constituting parts of a radial plane. The knives also have acute-angle edges facing forward in the direction of rotation.

Figure 1:
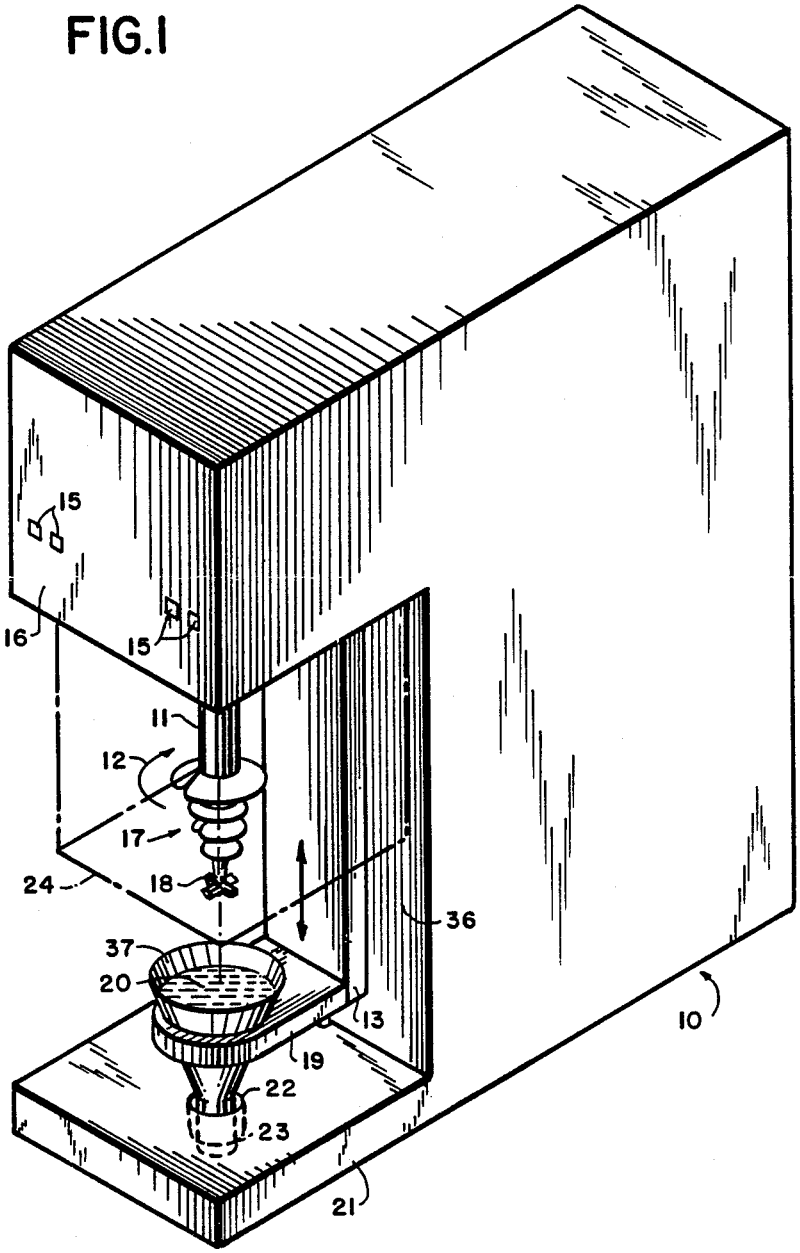

The invention will now be explained in a more detailed manner with reference to the exemplary embodiment of a mixing apparatus according to the invention as shown in the accompanying drawings, in which FIG. 1 is a schematic illustration of an apparatus according to the invention as seen in isometric perspective view, FIG. 2 in a large scale shows a mixing chamber and an associated mixing rotor in longitudinal sectional view and is a side elevational view respectively.

Figure 2:
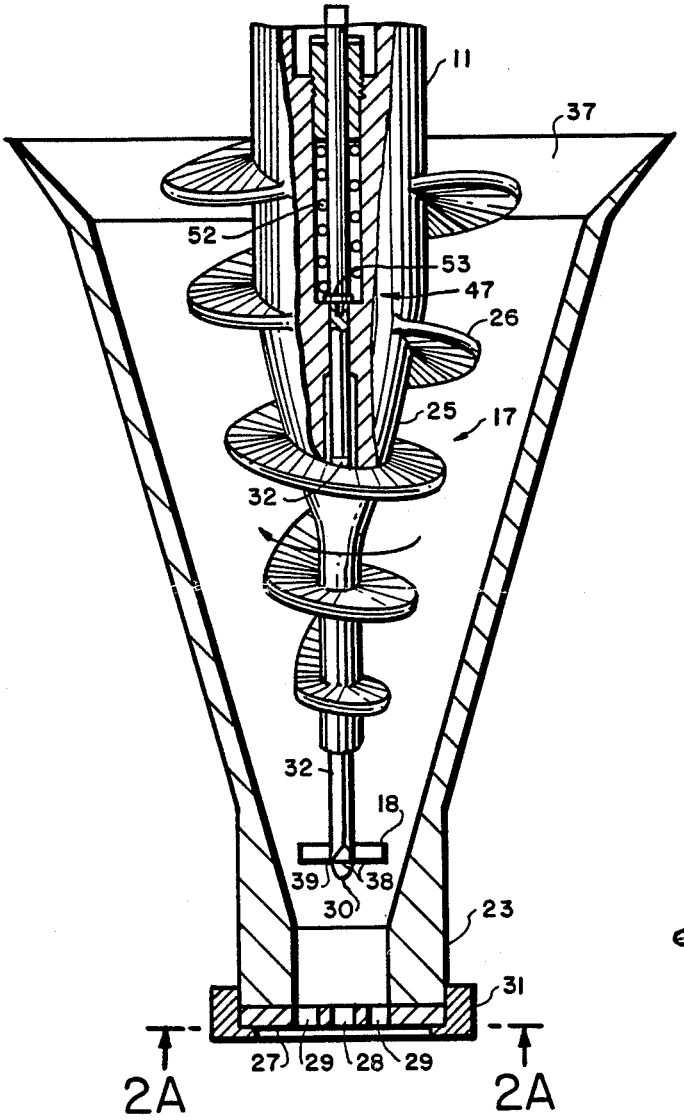
Figure 2A:
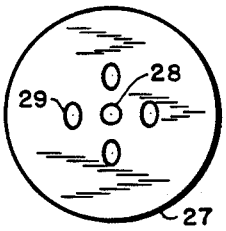
Figure 3:
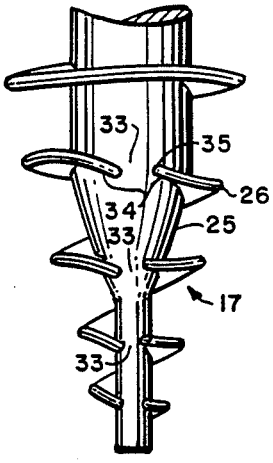
Figure 4:
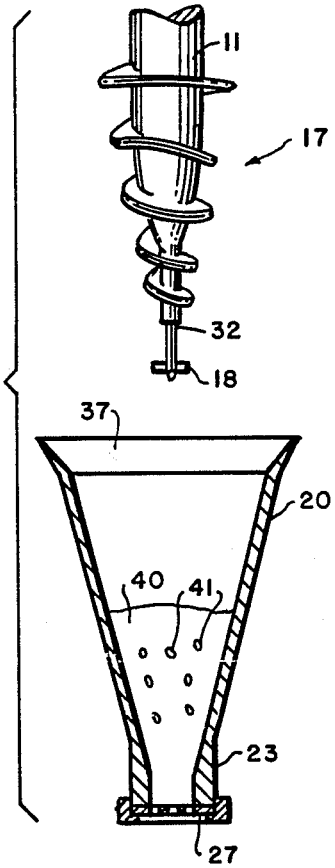
Figure 5:
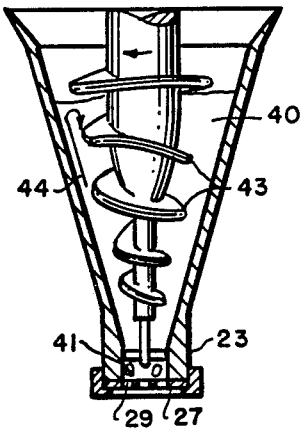
Figure 6:
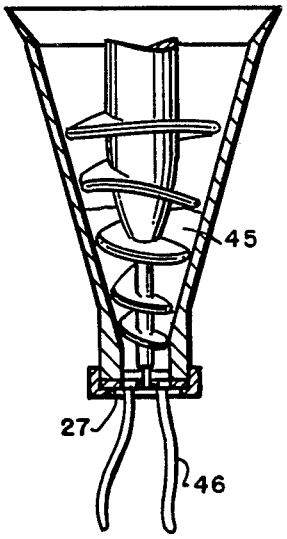

FIG. 2*a* shows a bottom view of an associated disc with exit openings,

FIG. 3 in a somewhat smaller scale shows an alternative embodiment of the main body of a mixing rotor, and FIGS. 4–6 in a further reduced scale shows the mixing rotor with associated mixing chamber in three different relative positions corresponding to the various operational steps of the apparatus.

The apparatus shown in FIG. 1 comprises a cabinet 10 enclosing various components (not shown) of the apparatus, such as a motor with associated transmission means for driving a mixing rotor shaft 11 in the direction shown by the arrow 12, and a pneumatic cylinder for raising and lowering a carriage 13 as indicated by the double arrow 14, as well as the requisite power supply and control arrangements, the latter represented by the diagrammatically shown control buttons and/or lamps 15 on the upper front panel 16 of the cabinet 10.

The drive shaft 11 carries a mixing rotor 17, which in the exemplary embodiment shown consists of a generally helical worm with a left-hand helix, so that rotation of the rotor 17 in the direction of the arrow 12 causes the convolutions of the worm to urge the material being mixed (not shown) downwards. At its lower end, the mixing rotor 17 carries a set of knives 18 spring-biased in the downward direction in a manner to be explained below. The mixing rotor 17 is preferably releasably connected to the drive shaft 11 by means of a bayonet coupling (not shown) or equivalent.

The vertically reciprocable carriage 13 comprises a mixing chamber carrier 19 protruding horizontally towards the front of the apparatus. The carrier 19 is adapted to support—preferably releasably—a funnel-shaped mixing chamber 20 coaxially with the drive shaft 11 and the mixing rotor 17. The entrance opening to the mixing chamber is designated 37. In a protruding base part 21 of the apparatus there is an opening 22 for accommodating the lower part 23 of the mixing chamber 20 when the carriage 13 is in its lowermost position as shown. If the apparatus is placed on top of a deep-freeze chest (not shown) containing some or all of the material to be mixed in the apparatus, then a corresponding opening in the top cover of the deep-freeze chest aligned with the opening 22 may be arranged to receive surplus mixed material or drops of condensed moisture falling off the lower part 23.

The cabinet 10 shown in FIG. 1 may further comprise a safety apron 24 indicated in dotted lines, arranged to protect the operator from contact with the mixing rotor 17 and the drive shaft 11. The apron 24 is preferably made of a suitable transparent plastic, such as Perspex®, and is also preferably removable, suitable safety arrangements (not shown) being provided to prevent rotation of the shaft 11 in the absence of the apron 24. The apron 24 abuts against a lower front panel 36 on the cabinet 10, so that the mixing rotor 17 is covered on all sides. The cabinet 10 may contain ducts (not shown), possibly also a blower (not shown), to conduct cold air for cooling the mixing rotor 17 and the mixing chamber 20, such as from the inside of a deep-freeze chest, on which the cabinet 10 is placed. The cold air is preferably conducted into the upper part of the safety apron 24, the apron thus guiding the cold air towards the rotor 17 and chamber 20.

After placing the components to be mixed in the mixing chamber 20, it is possible by actuating the appropriate one of the control buttons 15 to cause the pneumatic cylinder (not shown) mentioned above to move the carriage 13 and with it the support 19 and the mixing chamber 20 upwards towards the mixing rotor 17. The pneumatic cylinder will then urge the mixing chamber 20 upwards with a pre-determined limited force, thus avoiding any risk of damaging the mixing rotor 17 or the set of knives 18 by forcing same against hard bodies, such as nuts, in the components placed in the mixing chamber 20. After a short interval these hard bodies, if any, will be comminuted by the knives 18, after which the mixing chamber 20 will be moved further upwards by the limited force from the pneumatic cylinder (not shown) into close cooperation with the mixing rotor 17 in a manner to be explained below, so that the finished mixture is ejected through exit openings 29 (not shown in FIG. 1) in the lower part 23 of the mixing chamber 20, such as into a serving cup held under the lower part 23 by the operator.

As will be seen from FIGS. 2–6, the mixing rotor 17 is shaped like a worm with a central core 25 carrying generally helical convolutions 26. In this connection special note should be made of the expression "generally", as the convolutions 26 are preferably not perfectly helical, but vary in pitch in various ways to be explained below. The convolutions 26 shown consist of a single "winding", but it lies within the scope of the invention to use two or more windings, some of which may extend only partially along the central core 25.

Further, the lower part 23 of the mixing chamber 20 is closed on the lower side by an apertured disc 27 with a central hole 28 and a number of peripheral holes 29. The central hole 28 is arranged to accommodate a hub 30 on the lower side of the set of knives 18, and the peripheral holes 29—four in the example shown—are arranged to cooperate with the knives 18 themselves, when the axial distance between mixing rotor 17 and the mixing chamber 20 is reduced as shown in FIGS. 5 and 6. The apertured disc 27 is held releasably against the lower end of the lower part 23 of the mixing chamber 20 by a coupling ring 30, arranged to cooperate with the lower part 23 in a manner not shown, such as by threaded engagement a bayonet-coupling arrangement or other equivalent features.

The set of knives 18 is carried by a stub shaft 32, being axially slidably but non-rotatably held in a suitable bore 47 in the lower end of the central core 25. A biasing spring 52 biases the stub shaft 32 and hence the set of knives 18 in the downward direction, downward movement out of said bore 47 being limited by suitable means, e.g., spring abutment collar 53 (not shown). As will be seen from FIG. 2, the knives 18 have surfaces 30 substantially constituting parts of one and the same radial plane (not shown) and forward acuteangle edges 39. This arrangement makes it possible for the knives 18 to cooperate with the apertured disc 27 roughly in the same manner as a mincing machine's knife set cooperates with the associated perforated disc.

In the exemplary embodiment of the mixing rotor 17 shown in FIG. 3, the convolutions 26 are interrupted by notches 33 in areas of maximum or at least non-minimum pitch 34. The trailing edge 35 of each notch 33 is deflected upwards, i.e. away from the exit end, causing extra turbulence in the area 34 and thus improving the mixing process.

The mixing and dispensing process will now be described with reference to FIGS. 4, 5 and 6.

The first step in the process in illustrated in FIG. 4, in which the mixing chamber 20 is completely out of reach of the mixing member 17, which may be non-rotating at this stage for purposes of safety. The components to be mixed, such as hard-frozen ice cream and frozen fruit chunks, are introduced in the mixing chamber 20 through the entrance opening 37, forming a charge consisting of relatively soft material 40 and small lumps of relatively hard material 41.

Then, the mixing chamber 20 is raised to the position shown in FIG. 5, where the distance between the mixing rotor 17, now rotating as shown by the arrow 42, and the mixing chamber 20 is considerably reduced, i.e. to a relatively small clearance 43. The mixing rotor 17 will now—due to the generally helical shape of its convolutions—urge the material between its convolutions downwards towards the peripheral holes 29 in the disc 27, but as the flow cross-sectional area of these holes is relatively small compared to that of the clearance 43, the material will flow upwards along the wall of the mixing chamber outside of the worm convolutions and later return downwards within the convolutions as shown by the arrow 44, then again upwards and so on. The lumps of hard material 41 will gradually be caught by the set of knives 18 and comminuted by these in cooperation with the peripheral holes 29, the knives 18 receding upwards by the stub shaft 32 (FIGS. 2 and 4) withdrawing into the central core 25 against the force of the biassing spring (not shown) mentioned above.

The circulatory process step illustrated in FIG. 5 may be continued for as long as desired, such as controlled by suitable timing and control circtuiry (not shown) in the cabinet 10, but often the change in consistency, i.e. softening, of the hard-frozen ice cream taking place is sufficient as a "control parameter", allowing the mixture chamber20 —being urged upwards by the limited force mentioned above—to move upwards as soon as the components are sufficiently soft, usually also signifying that they are intermixed to a sufficient degree.

The next step is then the dispensing step illustrated in FIG. 6; here, the mixing chamber 20 has moved upwards to such an extent that the clearance 43 shown in FIG. 5 has substantially disappeared, and the stub shaft 32 completely withdrawn into the bore in the central core 25, only the hub 30 protruding into the central hole 28 in the disc 27. The combination of the worm-shaped mixing rotor 17 and the funnel-shaped mixing chamber 20 now acts like a worm pump, pumping the finished mixture 45 out through the peripheral holes 29 in the disc 27 in the shape of extruded strands 46, that may be collected in a serving cup (not shown) held by the operator or a customer.

With a suitable shape of the convolutions on the mixing rotor 17 and the inside wall of the mixing chamber 20 it is possible to have the mixing chamber substantially completely emptied at the end of the dispensing step shown in FIG. 6, for which reason it will normally not be necessary to remove any residue from the mixing chamber before treating the next charge. This is, of course, a great advantage when using the apparatus for preparing portions of edible ice to be sold over the counter in a shop, in which the apparatus is installed.

The deviations from the purely helical shape, i.e. the variations in pitch, of the convolutions 26 shown in FIGS. 2 and 3 serve to bring about various pulsatory effects during the rotation of the mixing rotor 17, thus improving the mixing process. Other pulsatory effects may be attained by shaping the central core 25 as shown with a shape not quite "parallel" to the internal shape of the mixing chamber 20. The notches 33 shown in FIG. 3 serve to allow some local circulation from one side of each convolution to the other, and the upwardly deflected trailing edge 35 likewise shown in FIG. 3 serves to enhance such lock circulation by drawing an extra quantity of material down through the notches 33.

Numerous modifications of the apparatus are possible with the scope of the following claims. Thus, the relative movement between the mixing rotor and the mixing chamber need not necessarily be along a straight line, as long as the final dispensing stage is attained substantially in the manner illustrated in FIG. 6. Thus, some form of fully or partly arcuate movement could be envisaged, in which the mixing chamber remains stationary and the mixing rotor, from a position corresponding to the one shown in FIG. 6, is swung upwards and backwards away from the operator into a protective niche in the front of the cabinet and vice versa, the movement being suitably covered by a safety apron or shield cooperating with the requisite control contacts or valves with a view to protecting the operator from contact with the rotating mixing rotor.

What is claimed is:

1. A mixing apparatus for mixing materials to form a frozen confection comprising:

(a) a mixing chamber having an entrance opening to introduce materials to be mixed into the mixing chamber and an exit opening through which the materials leave the mixing chamber after mixing;

(b) a rotatable mixing means being removably insertable into the mixing chamber for mixing the materials together and having an active element shaped to urge the materials from said entrance opening to said exit opening, said active element having an outer contour defining a surface of rotation about the vertical axis of the mixing means whereby the surface of rotation is at least partly congruent with an inner wall portion of the mixing chamber which faces the outer contour of the rotatable mixing means within a range of positions of the mixing means in the mixing chamber, said surface of rotation diminishing in diameter in a direction from the entrance opening to the exit opening, said range of positions of the mixing member comprising a first position having a relatively large distance between the outer contour of the mixing member and the inner wall portion of the mixing chamber and a second position having a smaller distance between the outer contour of the mixing member and the inner wall portion of the mixing chamber when compared to said first position;

(c) a drive means for rotating the mixing member about its vertical axis in the mixing chamber; and (d) at least two knives positioned on the mixing means adjacent to and facing said exit opening in an end wall of the mixing chamber and extending in a generally radial direction from the vertical axis of the mixing means, the end wall of the mixing chamber having a side facing said knives and lying in a radical plane relative to the vertical axis.

2. The mixing apparatus according to claim 1 wherein the knives further comprise a spring means for biasing them in the direction of the exit opening of the mixing means.

3. A mixing apparatus according to claim 2, characterized in that the knives (18) are shaped with surfaces (38) facing the end wall (27) and substantially constituting parts of a radial plane and acute-angle edges (39) facing forward in the direction of rotation.

4. A mixing apparatus according to claim 1, characterized in that the knives (18) are shaped with surfaces (38) facing the end wall (27) and substantially constituting parts of a radial plane and acute-angle edges (39) facing forward in the direction of rotation.

* * * * *